US005561025A

United States Patent [19]

Torres et al.

[11] Patent Number: 5,561,025

[45] Date of Patent: Oct. 1, 1996

[54] TONER AGGREGATION PROCESSES

[75] Inventors: Francisco E. Torres, Mississauga; Raj D. Patel, Oakville; Michael A. Hopper, Toronto; Grazyna E. Kmiecik-Lawrynowicz, Burlington, all of Canada

[73] Assignee: Xerox Corporation, Stamford, Conn.

[21] Appl. No.: 497,996

[22] Filed: Jul. 3, 1995

[51] Int. Cl.[6] ..... G03G 9/087

[52] U.S. Cl. ..... 430/137; 524/745

[58] Field of Search ..... 430/109, 137; 524/458, 745

[56] References Cited

U.S. PATENT DOCUMENTS

| | | | |
|---|---|---|---|
| 4,186,120 | 1/1980 | Ugelstad | 524/458 |
| 4,327,004 | 4/1982 | Schmidt et al. | 527/745 |
| 4,797,339 | 1/1989 | Marayama et al. | 430/109 |
| 4,983,488 | 1/1991 | Tan et al. | 430/137 |
| 4,996,127 | 2/1991 | Hasegawa et al. | 430/109 |
| 5,403,693 | 4/1995 | Patel et al. | 430/137 |
| 5,418,108 | 5/1995 | Kmiecik-Lawrynowicz | 430/137 |
| 5,455,315 | 10/1995 | Paine et al. | 430/109 |

*Primary Examiner*—John Goodrow
*Attorney, Agent, or Firm*—E. O. Palazzo

[57] ABSTRACT

A process for the preparation of polymer latex particles which comprises the emulsion polymerization of a mixture of monomer, polar comonomer, water, surfactant, initiator, and a water phase termination agent, and wherein the water phase termination agent is selected from the group consisting of butanethiol, pentanethiol, hexanethiol, heptanethiol, octanethiol, and carbon tetrabromide ($CBr_4$).

25 Claims, No Drawings

TONER AGGREGATION PROCESSES

BACKGROUND OF THE INVENTION

The present invention is generally directed to toner processes, and more specifically, to the preparation of resin particles by emulsion polymerization, and which resin particles can be selected for use in toner aggregation and coalescence processes, reference, for example, U.S. Pat. Nos. 5,344,738; 5,403,693; 5,418,108; and 5,364,729, the disclosures of which are totally incorporated herein by reference. In embodiments, the present invention is directed to the economical in situ chemical preparation of toners without the utilization of the known pulverization and/or classification methods, and wherein toners with an average volume diameter of from about 1 to about 25, and preferably from 1 to about 10 microns, and narrow size distribution can be obtained, the size distribution as measured by GSD being in the range, for example, of about 1.05 to about 1.40, and preferably in the range of 1.05 to 1.3. The resulting toners can be selected for known electrophotographic imaging and printing processes, including color processes, and lithography.

In embodiments, the present invention is directed to emulsion polymerization processes whereby the colloidal properties of the resulting resin particles can be controlled in a manner that the latexes of resin particles may be aggregated and coalesced in the processes described in U.S. Pat. No. 5,403,693, and in similar processes, over a wider range of conditions and, therefore, with improved consistency and reproducibility. Specifically, U.S. Pat. No. 5,403,693 illustrates the addition of extra stabilizer after the formation and before the coalescence, or fusing of the desired aggregates, thereby "freezing" the aggregate size prior to the coalescence step. If no extra stabilizer is added, or if too little extra stabilizer is added, then the aggregates may exhibit an increased tendency to grow further in size during the coalescence step and the GSD of the particle size distribution will tend to increase, whereas if too much extra stabilizer is added, then the aggregates may begin to break apart. Since both the further growth/increase in GSD and the breaking apart of aggregates are generally not desired, there exists a need for a process wherein a limited range of concentrations of extra stabilizer can be used to "freeze" the aggregates without producing either undesirable growth or breakage. For aggregates formed from some latexes, this range is quite narrow, or may even not exist, because the latex properties are not optimized for the aggregation process.

Accordingly, the present invention is directed, in embodiments, to the use during emulsion polymerization of reagents that ensure adequate termination, for example by chain transfer termination, of growing oligomer chains either in the water phase or at the interfaces between the water and particle phases, phases which coexist during emulsion polymerization, to produce latex particles with colloidal properties that are more desirable for aggregation-coalescence processes than the properties of similar latexes made without such reagents. The particle phase refers to the growing particles, which comprise resin polymer, such as poly(styrene-co-butyl acrylate); monomer, such as styrene and butyl acrylate; and other reagents, or components, such as termination transfer agents, surfactants, and polar comonomers. Various effective amounts of termination agents, such as alkyl thiols, can be selected, such as from about 0.0002 moles per 100 grams of monomer to about 0.09 moles per 100 grams of monomer, and preferably from about 0.0005 moles per 100 grams of monomer to about 0.04 moles per 100 grams of monomer. The present invention in embodiments utilizes the above mentioned class of termination agents in the emulsion polymerization step to minimize or eliminate the breakdown of aggregated particles that may occur when practicing the processes disclosed in U.S. Pat. No. 5,403,693 and similar processes, thereby resulting in a superior process wherein the particle size is controlled over a substantially wider range of conditions.

While not being desired to be limited by theory, it is believed that the breaking apart of aggregates occurs when the additional surfactant that is added to "freeze" the aggregate size is able to penetrate between aggregated latex and/or pigment particles, thereby disrupting the attraction between these particles. This penetration can occur when these particles have not approached each other within a sufficiently short distance, which may be as small as 2 to 10 Angstroms, and form a sufficiently strong attraction. Thus, latex particles with colloidal properties which do not allow the particles to aggregate in a sufficiently intimate manner will form aggregates that are susceptible to breaking apart. For example, particles with a large number of charge groups of the same sign chemically bound to their surface (dissociatable polar groups arising from polar comonomers, acidic comonomers such as acrylic acid and methacrylic acid) will not experience as large an attraction to one another, since the charge groups on two neighboring particles will repel one another. These repulsions between the charge groups can render it more difficult for the particles to come into close contact. Even the hydrophilicity of polar but uncharged groups chemically bound to the surface may render it more difficult for the particles to come into close contact. When latexes are synthesized by emulsion polymerization with polar comonomers, an example being polar comonomers with groups that can dissociate to yield charged groups (e.g. acidic or basic comonomers such as acrylic acid), the polar comonomers may react to form polar groups which are chemically bound to the surfaces of particles, depending on the process and whether the disclosed termination agents are absent, which can prevent a sufficiently strong attraction from forming between two aggregating particles. When the attraction is not sufficiently strong, the aggregates formed from such particles will have a greater tendency to break apart. Agents which ensure adequate termination of growing chains either in the water phase or at the interfaces between the water and particle phases can be used in the emulsion polymerization to minimize or eliminate this problem, since such agents can reduce the number of such polar groups that are chemically bound to the surfaces of the resin particles. In this invention, such agents are, therefore, added in large enough amounts to ensure the desired termination, and the processing conditions are also chosen to ensure the desired termination, yielding latex particles with the desired colloidal properties.

While again not being desired to be limited by theory, it is expected that polar comonomers can react to become a part of either (i) species that reside primarily in the water phase, (ii) interfacially active species that adsorb onto the resin particles, or (iii) polymer chains that are incorporated into the bulk of the emulsion particles. In (iii), the polar comonomer units are chemically bound to the particle and will have very limited mobility below the glass transition temperature of the polymer, once the polymerization is completed; furthermore, such units will reside either at the surface or in the interior of the particles. Polar comonomer units which are chemically bound to the surface of the emulsion particles may weaken the aggregation of particles, and the use of termination agents reduces the degree to which such comonomers become chemically bound to the surfaces of the emulsion particles, thereby reducing or eliminating the problems arising from a weakened aggregation. When polar groups are chemically bound to the surfaces of latex particles, they may form a permanent barrier between aggregated latex particles which keeps the latex particles from strong attraction to each other. Conversely, adsorbed, but not chemically bound, interfacially active species containing polar units can change positions along the surface, as well as desorb, in order to allow the formation of closer and stronger attractions between primary particles. In emulsion polymerization, initiation of growing chains occurs primarily in the water phase, and the growing chains add polar comonomer units in relation to their concentration in the water phase. In the absence of termination, these growing chains eventually enter and incorporate into a particle, which may not be optimal for aggregation processes, however, the incorporation can be reduced by ensuring that a sufficient number of the growing chains are terminated either in the water phase or at the interface between the water and particle phases. The resulting molecules will then fall under (i) or (ii), rather than (iii), thus yielding latex particles with more favorable colloidal properties. Termination agents, such as certain chain transfer agents, with sufficient reactivity in the water phase or at the interfaces between the water and particle phases, can be used to effect the desired termination in polymerization processes. In embodiments, the present invention is directed to processes for controlling the colloidal properties of resin particles through the use of termination agents, including certain types of chain transfer agents, that ensure the mode of termination described herein, and in polymerizations with polar comonomers. As illustrated in the Examples hereinafter, some chain transfer agents used to modify the molecular weight of the resin are also effective in causing the mode of termination described above, but other chain transfer agents used to modify the molecular weight of the resin are not effective in this role.

In embodiments, the present invention is directed to synthesizing a latex for use in aggregation/coalescence processes for preparing toner, e.g. processes disclosed in U.S. Pat. No. 5,403,693, wherein a stabilizer is added to a suspension of aggregates prior to heating the aggregates to a sufficiently high temperature to enable fusing, or coalescence, of the aggregates, the action of the stabilizer being the prevention of further growth of the aggregates during the coalescence stage. It is believed that the use of termination agents during preparation of latexes by emulsion polymerization, namely, agents such as certain chain transfer agents which are believed to cause adequate termination either in the aqueous phase or at the interfaces of reacting latex particles during emulsion polymerization with polar comonomers, results in latex particles with improved colloidal properties in that breakup of aggregates during the coalescence stage is minimized or prevented with better control and over a wider range of conditions than is often achieved otherwise.

As an example, the present invention is directed, in embodiments, to an in situ process comprised of (i) first dispersing a pigment, such as SUNSPERSE CYAN™ or SUNSPERSE RED™, in an aqueous mixture containing a cationic surfactant, such as benzalkonium chloride (SANIZOL B-50™), utilizing a high shearing device, such as an IKA/Brinkmann Polytron, or microfluidizer or sonicator; (ii) thereafter shearing this mixture with a charged latex of suspended resin particles, such as poly(styrene/butylacrylate/acrylic acid), synthesized using a termination agent which ensures adequate termination either in the aqueous phase or at the interfaces of emulsion particles, of particle size ranging from about 0.01 to about 0.5 micron as measured by the Brookhaven nanosizer, in an aqueous surfactant mixture containing an anionic surfactant, such as sodium dodecylbenzene sulfonate, for example NEOGEN R™ or NEOGEN SC™, and nonionic surfactant, such as alkyl phenoxy poly(ethyleneoxy) ethanol, for example IGEPAL 897™ or ANTAROX 897™, thereby resulting in a flocculation, or heterocoagulation of the resin particles with the pigment particles; and (iii) further stirring for from about 1 hour to about 24 hours with optional heating at from about 0° to about 25° C. below the resin Tg, which Tg is in the range of between 45° to 90° C. and preferably between about 50 and 80° C., resulting in formation of statically bound aggregates ranging in size of from about 0.5 micron to about 10 microns in volume average diameter size as measured by the Coulter Counter (Microsizer II); and (iv) adding concentrated (from about 5 percent to about 30 percent) aqueous surfactant solution containing an anionic surfactant, such as sodium dodecylbenzene sulfonate, for example NEOGEN R™ or NEOGEN SC™, or nonionic surfactant, such as alkyl phenoxy poly(ethyleneoxy) ethanol, for example IGEPAL 897™ or ANTAROX 897™, in controlled amounts to prevent any changes in particle size and in GSD of the size distribution, which can range from about 1.16 to about 1.28, during the heating step, and thereafter, heating to 10° to 50° C. above the resin Tg to provide for particle fusion or coalescence of the polymer and pigment particles; followed by washing with, for example, water to remove surfactants, and drying, whereby toner particles comprised of resin and pigment with various particle size diameters can be obtained, such as from 1 to 12 microns in average volume particle diameter, and preferably in the range of 3 to 9 microns, and wherein the stirring speed in (iii) is reduced in (iv) as illustrated in U.S. Pat. No. 5,403,693. The aforementioned toners are especially useful for the development of colored images with excellent line and solid resolution, and wherein substantially no background deposits are present. This invention is directed in embodiments to the synthesis of latex particles whereby the behavior of the suspended aggregates in the heating, or coalescence step is improved by the use during the emulsion polymerization of termination agents, such as chain transfer agents, which can increase the rate of termination of growing chains in the water phase or at the interfaces between the particles and the water phase. When such reagents are used, the propensity of aggregates to fall apart upon addition of extra surfactant and subsequent heating of the aggregates during (iv) is diminished.

Of importance with respect to the processes of the present invention in embodiments is the combination of (a) adding a termination agent, for example 1-butanethiol, 1-octanethiol or $CBr_4$, with sufficient reactivity in the water phase or at the interface of the water and particle phases, such as a chain transfer agent with sufficient water solubility or interfacial activity, during formation or growth by emulsion polymerization of resin particles; and (b) controlling the amount of anionic or nonionic surfactant added to already formed aggregates, as disclosed in U.S. Pat. No. 5,403,693, to ensure, for example, that the dispersion of aggregated particles remains stable and thus can be effectively utilized in the coalescence process in a manner which maintains control of particle size and particle size distribution. The addition of the extra portion of anionic or nonionic surfactant prior to coalescence increases the repulsion between the aggregates, thus enhancing the stability of the aggregated system against further increase in aggregate size to such an extent that the aggregates can essentially retain their particle size during the coalescence step. Controlling the amount of added surfactant in (b) can be important, especially for the preparation of small toner composite particles, since one can control particle growth in the aggregation step and retain those particles through the heating stage. These advantages are disclosed in U.S. Pat. No. 5,403,693. Conversely, the aggregates may break apart into smaller entities upon addition of this extra stabilizer and subsequent heating, which is detrimental to the process and product. The tendency of the aggregates to break apart, when it occurs, may be reduced or eliminated by using a sufficient amount of any terminating agent capable of causing adequate termination of growing chains either in the water phase or at the interface between the water and particle phases when preparing the latex by, for example, emulsion polymerization.

There is illustrated in U.S. Patent 4,996, 127 a toner of associated particles of secondary particles comprising primary particles of a polymer having acidic or basic polar groups and a coloring agent. The polymers selected for the toners of this '127 patent can be prepared by an emulsion polymerization method, see for example columns 4 and 5 of this patent. In column 7 of this '127 patent, it is indicated that the toner can be prepared by mixing the required amount of coloring agent and optional charge additive with an emulsion of the polymer having an acidic or basic polar group obtained by emulsion polymerization. Also, note column 9, lines 50 to 55, wherein a polar monomer, such as acrylic acid, in the emulsion resin is necessary, and toner preparation is not obtained without the use, for example, of acrylic acid polar group, see Comparative Example I. Unlike in the present invention, aggregates in the process described by U.S. Pat. No. 4,996,127 continue to increase in size when the temperature of the suspension of aggregates is increased, including when the suspension is heated in order to fuse the aggregates. No method of minimizing or preventing the growth of aggregates prior to fusing, or coalescence is disclosed, nor is a method disclosed for reducing the tendency of aggregates to break apart upon addition of extra stabilizers and subsequent heating, when such a tendency arises. Furthermore, the use of termination agents during emulsion polymerization to advantageously alter the colloidal properties of the latex particles is not disclosed. In U.S. Pat. No. 4,983,488, there is illustrated a process for the preparation of toners by the polymerization of a polymerizable monomer dispersed by emulsification in the presence of a colorant and/or a magnetic powder to prepare a principal resin component, and then effecting coagulation of the resulting polymerization liquid in such a manner that the particles in the liquid after coagulation have diameters suitable for a toner. It is indicated in column 9 of this patent that coagulated particles of 1 to 100, and particularly 3 to 70 are obtained. This process is thus primarily directed to the use of coagulants, such as inorganic magnesium sulfate which results in the formation of particles with wide GSD. Similarly, the aforementioned disadvantages are noted in other prior art, such as U.S. Pat. No. 4,797,339, wherein there is disclosed a process for the preparation of toners by resin emulsion polymerization, wherein similar to the '127 patent polar resins of opposite charges are selected, and wherein flocculation is not disclosed; and U.S. Pat. No. 4,558,108, wherein there is disclosed a process for the preparation of a copolymer of styrene and butadiene by specific suspension polymerization. Other patents mentioned are U.S. Pat. Nos. 3,674,736; 4,137,188 and 5,066, 560.

In U.S. Pat. No. 5,290,654, the disclosure of which is totally incorporated herein by reference, there is disclosed a process for the preparation of toners comprised of dispersing a polymer solution comprised of an organic solvent and a polyester, and homogenizing and heating the mixture to remove the solvent and thereby form toner composites. Additionally, there is disclosed in U.S. Pat. No. 5,278,020, the disclosure of which is totally incorporated herein by reference, a process for the preparation of in situ toners comprising a halogenization procedure which, for example, chlorinates the outer surface of the toner and results in enhanced blocking properties.

In U.S. Pat. No. 5,308,734, the disclosure of which is totally incorporated herein by reference, there is illustrated a process for the preparation of toner compositions which comprises generating an aqueous dispersion of toner fines, ionic surfactant and nonionic surfactant, adding thereto a counterionic surfactant with a polarity opposite to that of said ionic surfactant, homogenizing and stirring said mixture, and heating to provide for coalescence of said toner fine particles.

In U.S. Pat. No. 5,346,797, the disclosure of which is totally incorporated herein by reference, there is disclosed a process for the preparation of toner compositions comprising (i) preparing a pigment dispersion in a water, which dispersion is comprised of a pigment, an ionic surfactant, and optionally a charge control agent;

(ii) shearing the pigment dispersion with a latex mixture comprised of a counterionic surfactant with a charge polarity of opposite sign to that of said ionic surfactant, a nonionic surfactant and resin particles, thereby causing a flocculation or heterocoagulation of the formed particles of pigment, resin and charge control agent to form electrostatically bounded toner size aggregates; and (iii) heating the statically bound aggregated particles to form said toner composition comprised of polymeric resin, pigment and optionally a charge control agent.

Also, a number of copending applications illustrate various emulsion/aggregation processes for the preparation of toners, such as U.S. Pat. Nos. 5,344,738; 5,403,693; 5,418, 108; and 5,364,729, the disclosures of which are totally incorporated herein by reference. In U.S. Pat. No. 5,403,693, there is illustrated an emulsion-aggregation process where during the process there is added further anionic or nonionic surfactant in the range of from about 0.1 to about 10 percent by weight of water to control, prevent, or minimize further growth or enlargement of the particles in the coalescence step. The present patent application teaches the use of termination agents in the preparation of polymer particles by emulsion polymerization in a manner that reduces the tendency of the aggregates formed from such particles to break apart in, for example, the emulsion/aggregation process described in U.S. Pat. No. 5,403,693.

SUMMARY OF THE INVENTION

It is an object of the present invention to provide toner processes with many of the advantages illustrated herein.

In another object of the present invention there are provided processes for modifying the colloidal properties of latexes synthesized by emulsion polymerization, or similar techniques in order to improve the behavior of such latexes in emulsion-aggregation processes, like those processes disclosed in U.S. Pat. No. 5,403,693 for preparing toner. Specifically, processes to reduce or eliminate the tendency of aggregates to break apart during coalescence with extra stabilizer, when such a tendency exists, are provided. The processes for favorably modifying the colloidal properties of the latex comprise performing emulsion polymerization with reagents that ensure adequate termination, for example by chain transfer termination, of growing oligomer chains either in the water phase or at the interfaces between the water and particle phases, phases which coexist during emulsion polymerizations. These agents should be added in large enough amounts to ensure the desired termination. For example, adequate amounts of alkyl thiol termination agents generally employed in embodiments are from about 0.0002 moles per 100 grams of monomer to about 0.09 moles per 100 grams of monomer, and preferably from about 0.0005 moles per 100 grams of monomer to about 0.04 moles per 100 grams of monomer. To illustrate, as an example, the improvement arising from the use of such termination agents, emulsion polymerizations with a mixture of styrene, butyl acrylate, and acrylic acid monomers were performed with and without the addition of 1-butanethiol, a known and highly effective agent for chain transfer termination. In the reaction with 1-butanethiol, the amount selected was, for example, 0.074 gram per 100 grams of monomer. The solubility of 1-butanethiol in water is about $7\times10^{-3}$M at 25° C., so it is expected to cause significant termination of growing chains in the aqueous phase by chain transfer. When the latex synthesized with 1-butanethiol was used to generate toner according to the processes disclosed in U.S. Pat. No. 5,403,693, and in particular, when (i) 20 grams of SUNSPERSE MAGENTA™ quinacridone dispersed pigment were dispersed in 240 grams of water with 3.7 grams of SANIZOL B-50™ cationic surfactant, utilizing an IKA/Brinkmann Polytron; (ii) this mixture was sheared with 260 grams of the latex (40 weight percent solids) containing NEOGEN-R® anionic surfactant and ANTAROX CA897™ nonionic surfactant; (iii) the suspension was further stirred for 90 minutes at 45° C., resulting in aggregates of volume average diameter 3.3 microns and GSD equal to 1.22; (iv) an extra 70 milliliters of a solution of NEOGEN-R® anionic surfactant containing 20 weight percent actives were added to prevent further increases in particle size, thereby "freezing" the particle size after the formation of aggregates at 45° C.; and (v) the suspension of aggregates was heated to 93° C. for 4 hours to coalesce the aggregates, there was no observable breakdown of the toner particles. Before addition of extra stabilizer in the manner described above and in U.S. Pat. No. 5,403,693, the aggregate size was 3.3±0.3 micron and the GSD was 1.22, as measured by the Coulter Counter; after addition of extra stabilizer and coalescence, the size was 3.5+0.3 micron (essentially unchanged), and the GSD was 1.23. Conversely, when the latex synthesized without 1-butanethiol was subjected to addition of extra stabilizer and heated in the same manner, the aggregates broke apart, forming submicron entities. See the Examples below for more details.

In another object of the present invention there are provided simple and economical processes for the direct preparation of black and colored toner compositions with, for example, excellent pigment dispersion and narrow size distributions, as quantified, for example, by the GSD; and wherein the aggregates formed during the process are stabilized prior to coalescence above the glass transition temperature of the latex, resulting in minimal, or no further growth of the aggregates, and minimal, or no reduction in the size of the aggregates; and wherein the latex is prepared by emulsion polymerization using polar comonomer, e.g. dissociatable polar comonomer, e.g. acidic comonomer such as acrylic acid, and a termination agent in an amount which ensures adequate termination in the aqueous phase or at the interfaces between the water and particle phases, phases which coexist during emulsion polymerization, thereby yielding latex particles with the desired colloidal properties as evidenced by improved behavior in aggregation-coalescence processes.

In a further object of the present invention there is provided a process for the preparation of toner with an average particle diameter of from between about 1 to about 50 microns, and preferably from about 1 to about 7 microns, and with a narrow GSD of from about 1.2 to about 1.3 and preferably from about 1.16 to about 1.25 as measured by the Coulter Counter.

Moreover, in a further object of the present invention there is provided a process for the preparation of toners which, after fixing to paper substrates, results in images with gloss of from 20 GGU up to 70 GGU as measured by Gardner Gloss meter matching of toner and paper.

In another object of the present invention there are provided composite polar or nonpolar toner compositions in high yields of from about 90 percent to about 100 percent by weight of toner without resorting to classification.

In yet another object of the present invention there are provided toner compositions with low fusing temperatures of from about 110° C. to about 150° C., and with excellent blocking characteristics at from about 50° C. to about 60° C.

Moreover, in another object of the present invention there are provided toner compositions with a high projection efficiency such as from about 75 to about 95 percent efficiency as measured by the Match Scan II spectrophotometer available from Milton-Roy.

In a further object of the present invention there are provided toner compositions which result in low or no paper curl.

These and other objects of the present invention are accomplished in embodiments by the provision of toners and processes thereof. In embodiments of the present invention, there are provided processes for the economical direct chemical preparation of toner compositions by an improved flocculation or coagulation, and coalescence processes, and wherein the latex is synthesized in part or in entirety by an improved emulsion polymerization with polar comonomers and a termination agent that can increase the termination in the water phase or at the interface between the latex particles and the water, the termination being of oligomers containing the polar comonomer, thereby yielding latex particles with desirable colloidal properties, as evidenced by superior behavior with respect to aggregate stability during aggregation. The use of the termination agents enables the heating after the addition of extra surfactant, to take place over a wide range of conditions without significant reduction in the size, or breaking apart of the aggregates, since the latex particles form stronger aggregates. In embodiments, the present invention is directed to a process for the preparation of polymer latex particles which comprises the emulsion polymerization of a mixture of monomer, polar comonomer, water, surfactant, initiator, and a water phase termination agent, and wherein the water phase termination agent is selected from the group consisting of butanethiol, pentanethiol, hexanethiol, heptanethiol, octanethiol, and carbon tetrabromide ($CBr_4$).

The resin selected for the process of the present invention can be prepared by utilizing emulsion polymerization techniques or by utilizing other heterogeneous polymerization processes, such as polymer microsuspension processes or polymer solution microsuspension processes, in which more than one phase coexists and termination of growing chains in the continuous phase can alter the colloidal properties of the resulting discrete resin particles. The monomers utilized in such processes can be, for example, styrene, acrylates, methacrylates, butadiene, isoprene, and the like together with polar comonomers, such as acidic or basic olefinic monomers like acrylic acid, methacrylic acid, acrylamide, methacrylamide, quaternary ammonium halide of dialkyl or trialkyl acrylamides or methacrylamide, vinylpyridine, vinylpyrrolidone, vinyl-N-methylpyridinium chloride, and the like. Known chain transfer agents, such as 1-dodecanethiol, can also be selected to modify the molecular weight when preparing resin particles. Either surfactant or surfactant free emulsion polymerizations can be used to produce the latex particles, and if surfactants are added, they can be anionic, nonionic, cationic surfactants, or a mixture thereof. Initiators utilized in such processes can be, for example, ammonium persulfate, potassium persulfate, and other initiator substances with sufficient solubility in water. In addition, a termination agent (or combination of termination agents), which can ensure adequate termination in the water phase or at the interfaces of growing particles and the water phase, is (are) to be used as an essential reactant (as essential reactants) in the polymerization processes disclosed by this invention. The reaction can be performed using known polymerization protocols, including batch and semi-batch emulsion polymerization. Once the latex is produced, it is aggregated and coalesced according to U.S. Pat. No. 5,403,693 or another aggregation-coalescence process. Other processes for obtaining resin particles of from about 0.01 micron to about 3 microns can be selected from polymer microsuspension process, such as disclosed in U.S. Pat. No. 3,674,736, the disclosure of which is totally incorporated herein by reference, and polymer solution microsuspension process, such as disclosed in U.S. Pat. No. 5,290,654, the disclosure of which is totally incorporated herein by reference.

Illustrative examples of resin particles produced with the processes of the present invention include particles of known polymers such as poly(styrene-butadiene), poly(para-methyl styrene-butadiene), poly(meta-methyl styrene-butadiene), poly(alpha-methyl styrene-butadiene), poly(methylmethacrylate-butadiene), poly(ethylmethacrylate-butadiene), poly(propylmethacrylate-butadiene), poly(butylmethacrylate-butadiene), poly(methylacrylate-butadiene), poly(ethylacrylate-butadiene), poly(propylacrylate-butadiene), poly(butylacrylate-butadiene), poly(styrene-isoprene), poly(para-methyl styrene-isoprene), poly(meta-methyl styrene-isoprene), poly(alpha-methylstyrene-isoprene), poly(methylmethacrylate-isoprene), poly(ethylmethacrylate-isoprene), poly(propylmethacrylate-isoprene), poly(butylmethacrylate-isoprene), poly(methylacrylate-isoprene), poly(ethylacrylate-isoprene), poly(propylacrylate-isoprene), poly(butylacrylate-isoprene), polyethylene-terephthalate, polypropylene-terephthalate, polybutylene-terephthalate, polypentylene-terephthalate, and the like; copolymers with additional units corresponding to polar comonomers like acidic and basic comonomers, for example poly(styrene-butadiene-acrylic acid), poly(styrene-butadiene-methacrylic acid), and the like. The resin selected for the process of the present invention generally can be in embodiments styrene acrylates, styrene butadienes, styrene methacrylates, or the like, and are present in various effective amounts, such as from about 85 weight percent to about 98 weight percent of the toner, and can be of small average particle size, such as from about 0.01 micron to about 1 micron in average volume diameter as measured by the Brookhaven nanosize particle analyzer.

Illustrative examples of termination agents to ensure adequate termination in the water phase or at the interfaces of particles and the water phase can be, for example, chain transfer agents with sufficient reactivity in the water or at interfaces, such as carbon tetrabromide, 1-butanethiol, 1-pentanethiol, 1-hexanethiol, 1-heptanethiol, and 1-octanethiol, and isomers of these compounds; monomers that exhibit sufficiently high termination that their use ensures the desired termination in the water phase; and retarders, of which allyl acetate is an example. For clarity, we note that reference 2 defines polymerization retarders to be substances which interrupt the propagation of previously initiated chains; other literature often invokes a more ambiguous definition. Regarding the alkyl mercaptans mentioned above, all are known chain transfer agents and can affect the molecular weight of species during polymerizations, however, 1-dodecanethiol has negligible solubility in water, and thus does not effectively act as an agent for termination either in the water phase or at the interfaces between the particle and water phases. Conversely, the lower homologs can yield latex particles with the desired properties, when present in sufficient concentrations, as demonstrated in the Examples below. The effective concentrations of the disclosed class of termination agents are set primarily by the ability to ensure adequate termination as described herein, and the concentration will vary from species to species depending on the termination kinetics and the solubility of the termination agent in the continuous phase of the polymerization, for example water; given this clarification, an effective concentration of alkyl thiols generally employed in embodiments to ensure adequate termination in the aqueous phase or at the interfaces between the particle and aqueous phases is, as an example, from about 0.0002 moles per 100 grams of monomer to about 0.09 moles per 100 grams of monomer, and preferably from about 0.0005 moles per 100 grams of monomer to about 0.04 moles per 100 grams of monomer.

Also, in embodiments the present invention is directed to in situ processes for the preparation of toner compositions which comprises (i) preparing an ionic pigment mixture by dispersing a pigment, such as carbon black like REGAL 330®, HOSTAPERM PINK™, or PV FAST BLUE™, of from about 2 to about 10 percent by weight of toner in an aqueous mixture cationic surfactant, such as dialkylbenzene dialkylammonium chloride like SANIZOL B-50™ available from Kao or MIRAPOL™ available from Alkaril Chemicals, of from about 0.5 to about 2 percent by weight of water, utilizing a high shearing device, such as a Brinkmann Polytron or IKA homogenizer at a speed of from about 3,000 revolutions per minute to about 10,000 revolutions per minute for a duration of from about 1 minute to about 120 minutes; (ii) adding the aforementioned ionic pigment mixture to an aqueous suspension of containing resin particles comprised of, for example, poly(styrene-butylmethacrylate) or poly(styrene-butadiene) of from about 88 percent to about 98 percent by weight of the toner, and of about 0.1 micron to about 3 microns polymer particle size in volume average diameter, and synthesized by emulsion polymerization in the presence of termination agents, such as chain transfer agents, that enable sufficient termination of growing oligomers in the water phase or at the water-polymer particle interface, and counterionic surfactant, such as an anionic surfactant, such as sodium dodecyl sulfate, dodecylbenzene sulfonate or NEOGEN R™, from about 0.5 to about 2 percent by weight of water, a nonionic surfactant, such polyethylene glycol or polyoxyethylene glycol nonyl phenyl ether or IGEPAL 897™ obtained from GAF Chemical Company, of from about 0.5 to about 3 percent by weight of water, thereby causing a flocculation or heterocoagulation of pigment, charge control additive and resin particles; (iii) homogenizing the resulting flocculent mixture with a high shearing device, such as a Brinkmann Polytron or IKA homogenizer, at a speed of from about 3,000 revolutions per minute to about 10,000 revolutions per minute for a duration of from about 1 minute to about 120 minutes, thereby resulting in a homogeneous mixture of latex and pigment; and stirring with a mechanical stirrer from about 300 to about 800 rpm with heating to 5° C. to 25° C. below the resin Tg, where the resin Tg is preferably 54° C., for 1 to 24 hours to form electrostatically stable aggregates of from about 0.5 micron to about 5 microns in average volume diameter; (iv) adding extra anionic surfactant or nonionic surfactant in the amount of from 0.5 percent to 5 percent by weight of the water to stabilize aggregates formed in the previous step; (v) heating the statically bound aggregate composite particles at from about 60° C. to about 95° C., for example from about 5° C. to about 50° C. above the resin Tg, which is preferably 54° C., and for a duration of about 60 minutes to about 600 minutes to form toner sized particles of from about 3 microns to about 7 microns in volume average diameter and with a geometric size distribution of from about 1.2 to about 1.3 as measured by the Coulter Counter; and (vi) isolating the toner sized particles by washing, filtering and drying thereby providing a composite toner composition. Additives to improve flow characteristics, and charge additives to improve charging characteristics may then optionally be added by blending with the toner, such additives including AEROSILS® or silicas, metal oxides like tin, titanium and the like of from about 0.1 to about 10 percent by weight of the toner.

Various known colorants or pigments present in the toner in an effective amount of, for example, from about 1 to about 25 percent by weight of the toner, and preferably in an amount of from about 1 to about 15 weight percent that can be selected include carbon black like REGAL 330®, REGAL 330R®, REGAL 660®, REGAL 660R®, REGAL 400®, REGAL 400R®, and other equivalent black pigments. As colored pigments, there can be selected known cyan, magenta, blue, red, green, brown, yellow, or mixtures thereof. Specific examples of pigments include phthalocyanine HELIOGEN BLUE L6900™, D6840™, D7080™, D7020™, PYLAM OIL BLUE™, PYLAM OIL YELLOW™, PIGMENT BLUE 1™ available from Paul Uhlich & Company, Inc., PIGMENT VIOLET 1™, PIGMENT RED 48™, LEMON CHROME YELLOW DCC 1026™, E.D. TOLUIDINE RED™ and BON RED C™ available from Dominion Color Corporation, Ltd., Toronto, Ontario, NOVAperm YELLOW FGL™, HOSTAPERM PINK E™ from Hoechst, and CINQUASIA MAGENTA™ available from E.I. DuPont de Nemours & Company, and the like. Generally, colored pigments that can be selected are cyan, magenta, or yellow pigments. Examples of magenta materials that may be selected as pigments include, for example, 2,9-dimethyl-substituted quinacridone and anthraquinone dye identified in the Color Index as CI 60710, CI Dispersed Red 15, diazo dye identified in the Color Index as CI 26050, CI Solvent Red 19, and the like. Illustrative examples of cyan materials that may be used as pigments include copper tetra(octadecyl sulfonamido) phthalocyanine, x-copper phthalocyanine pigment listed in the Color Index as CI 74160, CI Pigment Blue, and Anthrathrene Blue, identified in the Color Index as CI 69810, Special Blue X-2137, and the like; while illustrative examples of yellow pigments that may be selected are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,5-dimethoxy acetoacetanilide, and Permanent Yellow FGL. The pigments or dyes selected are present in various effective amounts, such as from about 1 weight percent to about 65 weight and preferably from about 2 to about 12 percent of the toner.

The toner may also include known charge additives in effective amounts of, for example, from 0.1 to 5 weight percent such as alkyl pyridinium halides, bisulfates, the charge control additives of U.S. Pat. Nos. 3,944,493; 4,007,293; 4,079,014; 4,394,430 and 4,560,635, which illustrates a toner with a distearyl dimethyl ammonium methyl sulfate charge additive, the disclosures of which are totally incorporated herein by reference, negative charge additives like aluminum complexes, and the like.

Surfactants in amounts of, for example, 0.1 to about 25 weight percent in embodiments include, for example, nonionic surfactants such as dialkyphenoxypoly(ethyleneoxy) ethanol such as IGEPAL CA-210™, IGEPAL CA-520™, IGEPAL CA-720™, IGEPAL CO-890™, IGEPAL CO-720™, IGEPAL CO-290™, IGEPAL CA-210™, ANTAROX 890™, ANTAROX 897™, and the like. An effective concentration of the nonionic surfactant is, for example, from about 0.01 to about 10 percent by weight, and preferably from about 0.1 to about 5 percent by weight of monomers used to prepare the copolymer resin.

Examples of ionic surfactants include anionic and cationic surfactants, and examples of anionic surfactants include surfactants selected for the preparation of toners and the processes of the present invention are, for example, sodium dodecyl sulfate (SDS), sodium dodecylbenzene sulfonate, sodium dodecylnaphthalene sulfate, dialkyl benzenealkyl, sulfates and sulfonates, abitic acid available from Aldrich, NEOGEN R™, NEOGEN SC™ available from Kao, and the like. An effective concentration of the anionic surfactant generally employed is, for example, from about 0.01 to about 10 percent by weight, and preferably from about 0.1 to about 5 percent by weight.

Examples of the cationic surfactants selected for the toners and processes of the present invention are, for example, dialkyl benzenealkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, $C_{12}$, $C_{15}$, $C_{17}$ trimethyl ammonium bromides, halide salts of quaternized polyoxyethylalkylamines, dodecylbenzyl triethyl ammonium chloride, MIRAPOL™ and ALKAQUAT™ available from Alkaril Chemical Company, SANIZOL™ (benzalkonium chloride), available from Kao Chemicals, and the like, and mixtures thereof. This surfactant is utilized in various effective amounts, such as for example from about 0.1 percent to about 5 percent by weight of water. Preferably the molar ratio of the cationic surfactant used for flocculation to the anionic surfactant used in the latex preparation is in the range of about 0.5 to 4, and preferably from about 0.5 to 2.

Examples of the surfactant, which are added to the aggregated particles to "freeze" or retain particle size and GSD achieved in the aggregation, can be selected from anionic surfactants, such as sodium dodecylbenzene sulfonate, sodium dodecylnaphthalene sulfate, dialkyl benzenealkyl, sulfates and sulfonates available from Aldrich, NEOGEN R™ NEOGEN SC™ from Kao, and the like, reference U.S. Pat. No. 5,403,693. These surfactants also include nonionic surfactants such as polyvinyl alcohol, polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxy poly(ethyleneoxy) ethanol (available from Rhone-Poulenac as IGEPAL CA-210™, IGEPAL CA-520™, IGEPAL CA-720™, IGEPAL CO-890™, IGEPAL CO-720™, IGEPAL CO-290™, IGEPAL CA-210™, ANTAROX 890™ and ANTAROX 897™.

An effective concentration of the anionic or nonionic surfactant generally employed in embodiments as a "freezing agent" or stabilizing agent is, for example, from about 0.01 to about 30 percent by weight, and preferably from about 0.5 to about 5 percent by weight of the total weight of the aggregated mixture.

Surface additives that can be added to the toner compositions after washing or drying include, for example, metal salts, metal salts of fatty acids, colloidal silicas, mixtures thereof, and the like, which additives are usually present in an amount of from about 0.1 to about 2 weight percent, reference U.S. Pat. Nos. 3,590,000; 3,720,617; 3,655,374 and 3,983,045, the disclosures of which are totally incorporated herein by reference. Preferred additives include zinc stearate and AEROSIL R972®, available from Degussa, in amounts of from 0.1 to 2 percent, which can be added, for example, during the aggregation process or blended into the formed toner product.

Stirring speeds in (iii) are from about 300 to about 1,000 rpm, and this speed is reduced in (iv) as illustrated herein.

Developer compositions can be prepared by mixing the toners obtained with the processes of the present invention with known carrier particles, including coated carriers, such as steel, ferrites, and the like, reference U.S. Pat. Nos. 4,937,166 and 4,935,326, the disclosures of which are totally incorporated herein by reference, for example from about 2 percent toner concentration to about 8 percent toner concentration. Latent images can then be developed with the aforementioned toner, reference for example U.S. Pat. No. 4,265,690, the disclosure of which is totally incorporated herein by reference.

The following Examples are being submitted to further define various species of the present invention. These Examples are intended to be illustrative only and are not intended to limit the scope of the present invention. Also, parts and percentages are by weight unless otherwise indicated.

EXAMPLE I

Pigment dispersion: 9.6 grams of SUNSPERSE™ BHD6000 cyan pigment dispersion were dispersed in 240 grams of water with 1.8 grams of SANIZOL B-50™ cationic surfactant alkylbenzyldimethyl ammonium chloride.

A polymeric latex was prepared by emulsion polymerization of styrene/butylacrylate/acrylic acid, 82/18/2 parts (by weight) in nonionidanionic surfactant solution as follows: 328 grams of styrene, 72 grams of butylacrylate, 8 grams of acrylic acid, 12 grams of 1-dodecanethiol, and 4 grams of carbon tetrabromide as the invention termination agent was mixed with 600 grams of deionized water in which 10 grams of sodium dodecyl benzene sulfonate anionic surfactant (NEOGEN R™), and 4 grams of ammonium persulfate initiator were dissolved. Carbon tetrabromide is reported to have a solubility in water of about $7\times10^{-4}$M at 30° C., and it exhibits a high chain transfer constant, thus it is expected to cause significant termination of oligomers in the aqueous phase at 80° C. The emulsion was then polymerized at 80° C. The resulting latex contained 60 percent of water and 40 percent of solids of the styrene-butyl acrylateacrylic acid polymer 82/18/2; the molecular weight of the latex was $M_w$=25,546 and $M_n$=5,003 as determined on a Hewlett Packard GPC. The aforementioned latex was then selected for the toner preparation of Example I.

Preparation of Toner Size Particles:

Preparation of the aggregated particles: The 251.4 grams of pigment dispersion described above were added simultaneously with 260 grams of the above prepared latex into a G45M continuous stirring device (Janke & Kunkel IKA Labortechnik) containing 400 grams of water and an additional 1.5 grams of SANIZOL B-50™ cationic surfactant alkylbenzyldimethyl ammonium chloride. The pigment dispersion and the latex were well mixed by continuous pumping through the shearing chamber operating at 7,000 rpm for 3 minutes. This blend was then transferred into a kettle placed in a heating mantle and equipped with mechanical stirrer and temperature probe. The temperature of the mixture was raised from room temperature to 45° C. and the aggregation was performed for 150 minutes at 45° C. Aggregates with a particle size of 4.77 microns (GSD=1.18), as measured on the Coulter Counter, were obtained.

Coalescence of aggregated particles: 70 milliliters of a solution of NEOGEN R™ sodium dodecylbenzenesulfonate anionic surfactant containing 20 percent of the anionic surfactant was added to the suspension of aggregates to prevent any further change in aggregate size. The stirring speed was reduced from 400 to 150 rpm, and the temperature of the aggregated particles in the kettle was then raised to 93° C., and kept at 93° C. for 4 hours to coalesce the aggregates. At the end of the coalescence step, the particle size was 4.9 microns with a GSD=1.19. All particle sizes were measured on a Coulter Counter.

The resulting toner was comprised of about 95 percent of polymer, poly(styrene-butylacrylate-acrylic acid), and cyan pigment, about 5 percent by weight of toner, with an average volume diameter of 4.9 microns and a GSD of 1.19, indicating that by adding an extra amount of anionic surfactant prior to increasing the kettle temperature above the resin Tg to accomplish the coalescence, and reducing the stirring speed, one can retain particle size and GSD achieved in the aggregation step during coalescence, without the aggregates falling apart and without an excessive increase in particle size, when $CBr_4$ is added in the emulsion polymerization to ensure the formation of latex particles with desirable colloidal properties, presumedly by ensuring adequate termination of oligomers in the aqueous phase. The toner particles were then washed by filtration using hot water (50° C.) and dried on the freeze dryer.

Washing by filtration with hot water and drying with a freeze dryer was utilized in all the Examples unless otherwise indicated.

COMPARATIVE EXAMPLE IA

No Addition of Aqueous Phase Termination Agent

Pigment dispersion: 12 grams of SUNSPERSE™ BHD6000 cyan pigment dispersion was dispersed in 300 grams of water with 2.0 grams of SANIZOL B-50™ cationic surfactant alkylbenzyldimethyl ammonium chloride.

A polymeric latex was prepared by emulsion polymerization of styrene/butylacrylate/acrylic acid, 82/18/2 parts (by weight), in nonionidanionic surfactant solution as follows: 328 grams of styrene, 72 grams of butylacrylate, 8 grams of acrylic acid, and 12 grams of dodecanethiol were mixed with 600 grams of deionized water in which 10 grams of sodium dodecyl benzene sulfonate anionic surfactant (NEOGEN R™ which contains 60 percent of active component), 8.6 grams of polyoxyethylene nonyl phenyl ether—nonionic surfactant (ANTAROX 897™—70 percent active), and 4 grams of ammonium persulfate initiator were dissolved. No reactants were added for the purpose of increasing termination of oligomers in the aqueous phase or at the interfaces between the emulsion particles and the aqueous phase. The emulsion was then polymerized at 80° C. for 8 hours. The resulting latex contained 60 percent of water and 40 percent of solids of the styrene-butyl acrylateacrylic acid polymer, 82/18/2. The aforementioned latex was then selected for the toner preparation of Comparative Example IA.

Preparation of Toner Size Particles:

Preparation of the aggregated particles: The 314 grams of pigment dispersion described above were added simultaneously with 325 grams of the above prepared latex into a G45M continuous stirring device (Janke & Kunkel IKA Labortechnik) containing 500 grams of water, and an additional 1.83 grams of SANIZOL B-50™ cationic surfactant alkylbenzyldimethyl ammonium chloride were also added. The pigment dispersion and the latex were well mixed by continuous pumping through the shearing chamber operating at 7,000 rpm for 3 minutes. This blend was then transferred into a kettle placed in a heating mantle and equipped with mechanical stirrer and temperature probe. The temperature of the mixture was raised from room temperature to 45° C. and the aggregation was performed for 45 minutes at 45° C. Aggregates with a particle size of 3.4 microns (GSD=1.19), as measured on the Coulter Counter, were obtained.

Coalescence of aggregated particles: 90 milliliters of a solution of NEOGEN R™ sodium dodecylbenzenesulfonate anionic surfactant containing 20 percent of the anionic surfactant were added to the suspension of aggregates to prevent any further change in aggregate size. The stirring speed was reduced from 400 to 150 rpm, and the temperature of the aggregated particles in the kettle was then raised to 93° C., and kept at 93° C. for 4 hours to coalesce the aggregates. After 5 minutes, the particle size was less than 1.35 microns, indicating that the aggregates were falling apart. All particle sizes were measured on a Coulter Counter Multisizer II.

The aggregation at 45° C. was repeated with separate samples of the pigment dispersion and latex, after which the aggregates were coalesced without the addition of extra anionic surfactant. In the coalescence of this sample, the stirring speed was reduced from 400 to 150 rpm, and the temperature of the aggregated particles in the kettle was then raised to 90° C., and kept at 90° C. for 4 hours to coalesce the aggregates; no anionic surfactant was added after the aggregation at 45° C. was completed. The aggregate size grew during the coalescence step to 10.1 microns with a GSD of 1.26.

The aggregation at 45° C. was repeated a third time with separate samples of the pigment dispersion and latex. Aggregates with a particle size of 3.7 microns (GSD=1.18), as measured on the Coulter Counter, were obtained. Then, 22 milliliters of a solution of NEOGEN R™ sodium dodecylbenzenesulfonate anionic surfactant containing 25 percent of the anionic surfactant were added to the suspension of aggregates to prevent any further change in aggregate size. The stirring speed was reduced from 400 to 150 rpm, and the temperature of the aggregated particles in the kettle was then raised to 85° C., and kept at 85° C. for 4 hours to coalesce the aggregates. After 1 hour, the particle size was 3.8 microns with a GSD of 1.19; after 3 hours, the particle size was 2.7 microns with a GSD of 1.34; and after 4 hours, the particle size was 1.5 microns with a GSD of 1.30, indicating that the aggregates were falling apart.

These results indicate that the addition of an extra amount after the aggregation step and prior to the coalescence step in aggregation-coalescence processes of the types described herein causes the aggregates to have a greater propensity to fall apart when no termination agent is added during the emulsion polymerization to ensure that the latex particles have desirable colloidal properties. If no extra stabilizer is added, the particle size increases substantially, as demonstrated by this Comparative Example. Thus, the use of the class of termination agents described above during emulsion polymerization can yield latexes with superior behavior with respect to aggregation processes like those described herein.

EXAMPLE II

Pigment dispersion: 20 grams of SUNSPERSE MAGENTA™ quinacridone pigment dispersion were dispersed in 240 grams of water with 2.3 grams of SANIZOL B-50™ cationic surfactant alkylbenzyldimethyl ammonium chloride.

A polymeric latex was prepared by emulsion polymerization of styrene/butylacrylate/acrylic acid, 82/18/2 parts (by weight), in nonionic/anionic surfactant solution as follows: 328 grams of styrene, 72 grams of butylacrylate, 8 grams of acrylic acid, 6 grams of 1-dodecanethiol, and 0.36 milliliter of 1-butanethiol as the invention terminating agent component were mixed with 600 grams of deionized water in which 10 grams of sodium dodecyl benzene sulfonate anionic surfactant (NEOGEN R™ which contains 60 percent of active 8.6 grams of polyoxyethylene nonyl phenyl ether—nonionic surfactant (ANTAROX 897™—70 percent active), and 4 grams of ammonium persulfate initiator were dissolved. 1-Butanethiol is reported to have a solubility in water of about $7\times10^{-3}$M at 25° C., and it exhibits a high chain transfer constant, so it is expected to cause significant termination of oligomers in the aqueous phase. The emulsion was then polymerized at 80° C. for 8 hours. The resulting latex contained 60 percent of water and 40 percent of solids of the styrene-butyl acrylateacrylic acid polymer 82/18/2; the Tg of the latex dry sample was 66.4° C., as measured on a DuPont DSC; $M_w$=26,212, and $M_n$=9.753 as determined on a Hewlett Packard GPC. The aforementioned latex was then selected for the toner preparation of Example II.

Preparation of Toner Size Particles:

Preparation of the aggregated particles: The 262.3 grams of pigment dispersion described above were added simultaneously with 260 grams of the above prepared latex into a G45M continuous stirring device (Janke & Kunkel IKA Labortechnik) containing 400 grams of water, and an additional 1.4 grams of SANIZOL B-50™ cationic surfactant alkylbenzyldimethyl ammonium chloride. The pigment dispension and the latex were well mixed by continuous pumping through the shearing chamber operating at 5,000 rpm for 3 minutes. This blend was then transferred into a kettle placed in a heating mantle and equipped with mechanical stirrer and temperature probe. The temperature of the mixture was raised from room temperature to 45° C. and the aggregation was performed for 90 minutes at 45° C. Aggregates with a particle size of 3.3 microns (GSD=1.22), as measured on the Coulter Counter, were obtained.

Coalescence of aggregated particles: 70 milliliters of a solution of NEOGEN R™ sodium dodecylbenzenesulfonate anionic surfactant containing 20 percent of the anionic surfactant were added to the suspension of aggregates to prevent any further change in aggregate size. The stirring speed was reduced from 400 to 150 rpm, and the temperature of the aggregated particles in the kettle was then raised to 93° C., and kept at 93° C. for 4 hours to coalesce the aggregates. At the end of the coalescence step, the particle size was 3.5 microns with a GSD=1.23. All particle sizes were measured on a Coulter Counter.

The resulting toner was comprised of about 93 percent of polymer, poly(styrene-butylacrylate-acrylic acid), and magenta pigment, about 7 percent by weight of toner, with an average volume diameter of 3.5 microns and a GSD of 1.23, indicating that by adding an extra amount of anionic surfactant prior to increasing the kettle temperature above the resin Tg to accomplish the coalescence, and reducing the stirring speed, one can retain particle size and GSD achieved in the aggregation step during coalescence, without the aggregates falling apart, as evidenced by measurements with the above Coulter Counter, and without an excessive increase in particle size. The toner particles were then washed by filtration using hot water (50° C.) and dried on the freeze dryer.

EXAMPLE III

Pigment dispersion: 7.6 grams of SUNSPERSE™ BHD6000 cyan pigment dispersion were dispersed in 240 grams of water with 2.34 grams of SANIZOL B-50™ cationic surfactant alkylbenzyldimethyl ammonium chloride.

A polymeric latex was prepared by emulsion polymerization of styrene/butylacrylate/acrylic acid, 82/18/2 parts (by weight), in nonionic/anionic surfactant solution as follows: 328 grams of styrene, 72 grams of butylacrylate, 8 grams of acrylic acid, 6 grams of 1-dodecanethiol, and 1.8 milliliters of 1-butanethiol were mixed with 600 grams of deionized water in which 10 grams of sodium dodecyl benzene sulfonate anionic surfactant (NEOGEN R™ which contains 60 percent of active component), 8.6 grams of polyoxyethylene nonyl phenyl ether—nonionic surfactant (ANTAROX 897™—70 percent active), and 4 grams of ammonium persulfate initiator were dissolved. 1-Butanethiol is reported to have a solubility in water of about $7\times10^{-3}$M at 25° C., and it exhibits a high chain transfer constant, so it is expected to cause significant termination of oligomers in the aqueous phase. The emulsion was then polymerized at 80° C. for 8 hours. The resulting latex contained 60 percent of water and 40 percent of solids of the styrene-butyl acrylate-acrylic acid polymer, 82/18/2; the Tg of the latex dry sample was 64° C., as measured on a DuPont DSC; $M_w$=41,067, and $M_n$=7,928 as determined on a Hewlett Packard GPC. The aforementioned latex was then selected for the toner preparation of Example III.

Preparation of Toner Size Particles:

Preparation of the aggregated particles: The 249.94 grams of pigment dispersion described above were added simultaneously with 260 grams of the above prepared latex into a G45M continuous stirring device (Janke & Kunkel IKA Labortechnik) containing 300 grams of water. The pigment dispersion and the latex were well mixed by continuous pumping through the shearing chamber operating at 7,000 rpm for 3 minutes. This blend was then transferred into a kettle placed in a heating mantle and equipped with mechanical stirrer and temperature probe. The temperature of the mixture was raised from room temperature to 45° C., and the aggregation was performed for 225 minutes at 45° C. Aggregates with a particle size of 3.8 microns (GSD=1.18), as measured on the Coulter Counter, were obtained.

Coalescence of aggregated particles: 70 milliliters of a solution of NEOGEN R™ sodium dodecylbenzenesulfonate anionic surfactant containing 20 percent of the anionic surfactant were added to the suspension of aggregates to prevent any further change in aggregate size. The stirring speed was reduced from 400 to 150 rpm, and the temperature of the aggregated particles in the kettle was then raised to 93° C., and kept at 93° C for 4 hours to coalesce the aggregates. After 30 minutes, the particle size was 4.2 microns with a GSD of 1.18; after 2 hours the particle size was 4.3 microns with a GSD of 1.18; and at the end of the coalescence step the particle size was 4.3 microns with a GSD = 1.18. All particle sizes were measured on a Coulter Counter.

The resulting toner was comprised of 96.2 percent of polymer, poly(styrene-butylacrylate-acrylic acid), and cyan pigment, about 3.8 percent by weight of toner, with an average volume diameter of 4.3 microns and a GSD of 1.18, indicating that by adding an extra amount of anionic surfactant prior to increasing the kettle temperature above the resin Tg to accomplish the coalescence, and reducing the stirring speed, one can retain particle size and GSD achieved in the aggregation step during coalescence, without the aggregates falling apart and without an excessive increase in particle size, when 1-butanethiol is added in the emulsion polymerization to ensure that latex particles with desirable colloidal properties are synthesized. The toner particles were then washed by filtration using hot water (50° C.) and dried on the freeze dryer.

EXAMPLE IV

Pigment dispersion: 7.6 grams of SUNSPERSE™ BHD6000 cyan pigment dispersion were dispersed in 240 grams of water with 2.3 grams of SANIZOL B-50™ cationic surfactant alkylbenzyldimethyl ammonium chloride.

A polymeric latex (sample E-69) was prepared by emulsion polymerization of styrene/butylacrylate/acrylic acid, 82/18/2 parts (by weight), in nonionic/anionic surfactant solution as follows: 328 grams of styrene, 72 grams of butylacrylate, 8 grams of acrylic acid, and 16 grams of 1-dodecanethiol were mixed with 600 grams of deionized water in which 10 grams of sodium dodecyl benzene sulfonate anionic surfactant (NEOGEN R™ which contains 60 percent of active component), 8.6 grams of polyoxyethylene nonyl phenyl ether—nonionic surfactant (ANTAROX 897™—70 percent active), and 4 grams of ammonium persulfate initiator were dissolved. 1-Octanethiol has a solubility in water that is intermediate between 1-butanethiol and 1-dodecanethiol, so it is expected that the use of 1-octanethiol should more readily yield latex particles with superior aggregation-coalescence properties as described herein than 1-dodecanethiol. However, it is also expected that 1-octanethiol will not be as effective as 1-butanethiol and hence should be used at a larger concentration. Thus, the amount of 1-octanethiol in this Example is substantially larger than the amounts of 1-butanethiol in Examples II and III. 1-Butanethiol presents much more of an odor problem than 1-octanethiol, however, which may be more important in some applications than considerations about the amount of termination agent needed in a reaction. The emulsion was then polymerized at 80° C. for 8 hours. The resulting latex contained 60 percent of water and 40 percent of solids of the styrene-butyl acrylate-acrylic acid polymer, 82/18/2. The aforementioned latex was then selected for the toner preparation of Example IV.

Preparation of Toner Size Particles:

Preparation of the aggregated particles: The 249.9 grams of pigment dispersion described above were added simultaneously with 260 grams of the above prepared latex into a G45M continuous stirring device (Janke & Kunkel IKA Labortechnik) containing 400 grams of water. The pigment dispersion and the latex were well mixed by continuous pumping through the shearing chamber operating at 7,000 rpm for 3 minutes. This blend was then transferred into a kettle placed in a heating mantle and equipped with mechanical stirrer and temperature probe. The temperature of the mixture was raised from room temperature to 45° C. and the aggregation was performed for 105 minutes at 45° C., with intermediate reshearing in the IKA device. Aggregates with a particle size of 5.2 microns (GSD=1.19), as measured on the Coulter Counter, were obtained.

Coalescence of aggregated particles: 80 milliliters of a solution of NEOGEN R™ sodium dodecylbenzenesulfonate anionic surfactant containing 20 percent of the anionic surfactant were added to the suspension of aggregates to prevent any further change in aggregate size. The stirring speed was reduced from 400 to 150 rpm, and the temperature of the aggregated particles in the kettle was then raised to 93° C. and kept at 93° C. for 4 hours to coalesce the aggregates. After 30 minutes, the particle size was 5.8 microns with a GSD of 1.19; and at the end of the coalescence step the particle size was 5.9 microns with a GSD= 1.19. All particle sizes were measured on a Coulter Counter.

The resulting toner was comprised of 96 percent of polymer, poly(styrene-butylacrylate-acrylic acid), and cyan pigment, about 4 percent by weight of toner, with an average volume diameter of 5.9 microns and a GSD of 1.19, indicating that by adding an extra amount of anionic surfactant prior to increasing the kettle temperature above the resin Tg to accomplish the coalescence, and reducing the stirring speed, one can retain particle size and GSD achieved in the aggregation step during coalescence, without the aggregates falling apart and without an excessive increase in particle size, when 1-octanethiol is added in the emulsion polymerization to ensure that latex particles with desirable colloidal properties are synthesized. The toner particles were then washed by filtration using hot water (50° C.) and dried on the freeze dryer.

Other embodiments and modifications of the present invention may occur to those skilled in the art subsequent to a review of the information presented herein; these embodiments and modifications, as well as equivalents thereof, are also included within the scope of this invention.

What is claimed is:

1. A process for the preparation of polymer latex particles consisting essentially of the emulsion polymerization of a mixture of monomer, polar comonomer, water, surfactant, initiator, and a water phase termination agent, and wherein the water phase termination agent is selected from the group consisting of butanethiol, pentanethiol, hexanethiol, heptanethiol, octanethiol, and carbon tetrabromide, and wherein said termination agent functions to terminate oligomer formation, and wherein the oligomer possesses a weight average molecular weight in the range of from between about 1,000 to about 5,000, polymerization is accomplished by heating said mixture at a temperature of from between about 50° to about 95° C. and wherein said polymer particles formed are of a size diameter of from about 0.04 to about 1 micron, wherein said oligomer and said surfactant are adsorbed on the surface of said polymer particles, and wherein the monomer is selected from the group consisting of styrene, butyl acrylate, butadiene, para-methyl styrene, meta-methyl styrene, alpha-methyl styrene, methylmethacrylate, ethylmethacrylate, propylmethacrylate, isoprene, butylmethacrylate, methylacrylate, ethylacrylate, and propylacrylate.

2. A process in accordance with claim 1 wherein said termination agent functions to terminate oligomer formation, and wherein the oligomer possesses a weight average molecular weight in the range of from between about 1,000 to about 5,000, polymerization is accomplished by heating said mixture at a temperature of from between about 50° to about 95° C. and wherein said polymer particles formed are of a size diameter of from about 0.04 to about 1 micron, wherein said oligomer and said surfactant are adsorbed on the surface of said polymer particles, and wherein the monomer is selected from the group consisting of styrene, butyl acrylate, butadiene, para-methyl styrene, meta-methyl styrene, alpha-methyl styrene, methylmethacrylate, ethylmethacrylate, propylmethacrylate, isoprene, butylmethacrylate, methylacrylate, ethylacrylate, and propylacrylate.

3. A process for the preparation of polymer latex particles which comprises the emulsion polymerization of a mixture of monomer, polar comonomer, water, surfactant, initiator, and a water phase termination agent, and wherein the water phase termination agent is selected from the group consisting of butanethiol, pentanethiol, hexanethiol, heptanethiol, octanethiol, and carbon tetrabromide, and wherein said termination agent functions to terminate oligomer formation in the water phase and wherein the oligomer possesses a weight average molecular weight in the range of from between about 500 to about 10,000, wherein polymerization is accomplished by heating said mixture at a temperature of from between about 40° to about 95° C., and wherein said polymer particles formed are of a size diameter of from about 0.04 to about 1 micron, wherein said oligomer and said surfactant are adsorbed on the surface of said polymer particles, and wherein the monomer is selected from the group consisting of styrene, butyl acrylate, butadiene, para-methyl styrene, meta-methyl styrene, alpha-methyl styrene, methylmethacrylate, ethylmethacrylate, propylmethacrylate, isoprene, butylmethacrylate, methylacrylate, ethylacrylate, and propylacrylate, and wherein the water phase contains monomer, polar comonomer, suffactant, initiator, termination agent, and water.

4. A process in accordance with claim 2 wherein said polymer particles formed are of a size diameter of from about 0.04 to about 1 micron, said oligomers are adsorbed on said surface in an amount of from about 1 to about 10 weight percent based on the weight percent of monomer selected, and wherein the termination agent, or chain transfer agent is selected in the amounts of from about 0.0002 moles per 100 grams of monomer to about 0.09 moles per 100 grams of monomer.

5. A process in accordance with claim 2 wherein said polymer particles formed are of a size diameter of from about 0.04 to about 1 micron, said oligomers are adsorbed on said surface in an amount of from about 0.01 to about 10 weight percent based on the weight of monomer selected, and wherein the termination agent is selected in the amounts of from about 0.0002 moles per 100 grams of monomer to about 0.09 moles per 100 grams of monomer.

6. A process in accordance with claim 1 wherein the surfactant is a nonionic surfactant selected from the group consisting of polyvinyl alcohol, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, and dialkylphenoxy poly(ethyleneoxy) ethanol, is used to perform the polymerization.

7. A process in accordance with claim 1 wherein the surfactant is an anionic surfactant selected from the group consisting of sodium dodecyl sulfate, sodium dodecylbenzene sulfonate, and sodium dodecylnaphthalene sulfonate.

8. A process in accordance with claim 1 wherein the polar comonomer has an acidic or basic polar group and is acrylic acid, methacrylic acid, acrylamide, methacrylamide, quaternary ammonium halide of dialkyl or trialkyl acrylamides or methacrylamide, vinylpyridine, vinylpyrrolidone, or vinyl-N-methylpyridinium chloride.

9. A process for the preparation of toner compositions with controlled particle size comprising:

(i) preparing a pigment dispersion in water, which dispersion is comprised of a pigment, an ionic surfactant in amounts of from about 0.5 to about 10 percent by weight of water, and an optional charge control agent;

(ii) preparing a latex suspension of resin particles by the process of claim 1;

(iii) shearing the pigment dispersion with a latex mixture comprised of a counterionic surfactant with a charge polarity of opposite sign to that of said ionic surfactant, a nonionic surfactant, and resin particles synthesized in (ii), thereby causing a flocculation or heterocoagulation of the formed particles of pigment, resin, and charge control agent;

(iv) stirring the resulting sheared viscous mixture of (iii) to form substantially stable toner size aggregates with a narrow particle size distribution;

(v) subsequently adding further surfactant in the range of from about 0.1 to about 10 percent by weight of water to control, prevent, or minimize further growth or enlargement of the particles in the coalescence step (vi); and (vi) heating from about 5 to about 60° C. above about the resin glass transition temperature, Tg, which resin Tg is from between about 45° C. to about 90° C. and preferably from between about 50° C. and about 80° C., thereby coalescing the statically bound aggregated particles to form said toner composition comprised of resin, pigment and optional charge control agent.

10. A process in accordance with claim 9 wherein the surfactant utilized in preparing the pigment dispersion is a cationic surfactant in an amount of from about 0.01 percent to about 10 percent, and the counterionic surfactant present in the latex mixture is an anionic surfactant present in an amount of from about 0.2 percent to about 5 percent; and wherein the molar ratio of cationic surfactant introduced with the pigment dispersion to the anionic surfactant introduced with the latex can be varied from about 0.5 to about 5.

11. A process in accordance with claim 9 wherein control of the particle growth in the heating (vi) can be achieved by the addition of further anionic surfactant, from about 0.02 to about 5 percent by weight of water in step (v) after the aggregation in step (iv).

12. A process in accordance with claim 9 wherein the addition of further anionic surfactant in (v) further stabilizes the aggregated particles, and as a result fixes their size and particle size distribution as achieved in (iv), and wherein the particle size can be in the range of from about 3 to about 10 microns in volume average diameter, and the GSD is in the range of from about 1.16 to about 1.26.

13. A process in accordance with claim 12 wherein the anionic surfactant added acts to increase the electrostatic repulsions between the aggregates, thereby increasing their stability, and wherein the aggregates formed have a volume average diameter of from about 3 to about 10 microns and do not grow further in size.

14. A process in accordance with claim 9 wherein control of the particle growth in heating (vi) can be achieved by the addition of nonionic surfactant, from about 0.02 percent to 5 percent by weight of water, in (v) after the aggregation in (iv), and the speed in (v) and (vi) is reduced to from about 100 to about 600 revolutions per minute.

15. A process in accordance with claim 9 wherein said termination agent enables further stabilization of the aggregated particles, and as a result fixes their size and particle size distribution as achieved in (iv) of from about 3 to about 10 microns, and wherein the GSD thereof is from about 1.16 to about 1.26.

16. A process in accordance with claim 14 wherein said termination agent and the addition of nonionic surfactant further stabilizes the aggregated particles, and as a result fixes their size and particle size distribution as achieved in (iv) of from about 3 to about 10 microns, and wherein the GSD thereof is from about 1.20 to about 1.26.

17. A process in accordance with claim 9 wherein the anionic surfactant utilized for controlling, minimizing, or preventing particle growth in the coalescence step is comprised of sodium dodecyl benzene sulfonates.

18. A process in accordance with claim 9 wherein the nonionic surfactant utilized for controlling particle growth in the coalescence step (vi) is an alkyl phenoxypoly(ethylenoxy) ethanol.

19. A process in accordance with claim 9 wherein the heating of the statically bound aggregate particles to form toner size composite particles comprised of pigment, resin, and optional charge control agent is accomplished at a temperature of from about 60° C. to about 98° C., and for a duration of from about 10 minutes to about 8 hours.

20. A process in accordance with claim 9 wherein the polymer formed is selected from the group consisting of poly(styrene-butadiene), poly(para-methyl styrene-butadiene), poly(meta-methyl styrene-butadiene), poly(alpha-methylstyrene-butadiene), poly(methylmethacrylate-butadiene), poly(ethylmethacrylate-butadiene), poly(propylmethacrylate-butadiene), poly(butylmethacrylate-butadiene), poly(methylacrylate-butadiene), poly(ethylacrylate-butadiene), poly(propylacrylate-butadiene), poly(butylacrylate-butadiene), poly(styrene-isoprene), poly(para-methyl styrene-isoprene), poly(meta-methyl styrene-isoprene), poly(alpha-methylstyrene-isoprene), poly(methylmethacrylate-isoprene), poly(ethylmethacrylate-isoprene), poly(propylmethacrylate-isoprene), poly(butylmethacrylate-isoprene), poly(methylacrylate-isoprene), poly(ethylacrylate-isoprene), poly(propylacrylate-isoprene), and poly(butylacrylate-isoprene).

21. A process in accordance with claim 9 wherein the polymer formed is from about 0.01 to about 3 microns in average volume diameter, the pigment particles are from about 0.01 to about 1 micron in volume average diameter, the toner isolated is from about 3 to about 15 microns in average volume diameter, and the geometric size distribution thereof is from about 1.16 to about 1.30.

22. A process for the preparation of toner compositions with controlled particle size consisting of (i) preparing a pigment dispersion in water, which dispersion is comprised of a pigment, an ionic surfactant in amounts of from about 0.5 to about 10 percent by weight of water, and an optional charge control agent;

(ii) preparing a latex suspension of resin particles by a process consisting essentially of the emulsion polymerization of a mixture of monomer, polar comonomer, water, surfactant, initiator, and a water phase termination agent, and wherein the water phase termination agent is selected from the group consisting of butanethiol, pentanethiol, hexanethiol, heptanethiol, octanethiol, and carbon tetrabromide, and wherein said termination agent functions to terminate oligomer formation, and wherein the oligomer possesses a weight average molecular weight in the range of from between about 1,000 to about 5,000, polymerization is accomplished by heating said mixture at a temperature of from between about 50° to about 95° C. and wherein said polymer particles formed are of a size diameter of from about 0.04 to about 1 micron, wherein said oligomer and said surfactant are adsorbed on the surface of said polymer particles, and wherein the monomer is selected from the group consisting of styrene, butyl acrylate, butadiene, para-methyl styrene, meta-methyl styrene, alpha-methyl styrene, methylmethacrylate, ethylmethacrylate, propylmethacrylate, isoprene, butylmethacrylate, methylacrylate, ethylacrylate, and propylacrylate;

(iii) shearing the pigment dispersion with a latex mixture comprised of a counterionic surfactant with a charge polarity of opposite sign to that of said ionic surfactant, a nonionic surfactant, and resin particles synthesized in (ii), thereby causing a flocculation or heterocoagulation of the formed particles of pigment, resin, and charge control agent;

(iv) stirring the resulting sheared viscous mixture of (iii) to form substantially stable toner size aggregates with a narrow particle size distribution;

(v) subsequently adding further surfactant in the range of from about 0.1 to about 10 percent by weight of water to control, prevent, or minimize further growth or enlargement of the particles in the coalescence step (vi); and (vi) heating from about 5° to about 60° C. above about the resin glass transition temperature, Tg, which resin Tg is from between about 45° C. to about 90° C. and preferably from between about 50° C. and about 80° C., thereby coalescing the statically bound aggregated particles to form said toner composition comprised of resin, pigment and optional charge control agent.

23. A process in accordance with claim 22 wherein the resinous particles in the latex suspension are styrene/butyl acrylate/acrylic acid, the termination agent is 1-dodecanethiol, the surfactant is sodium dodecyl benzene sulfonate, and the initiator is ammonium persulfate.

24. A process in accordance with claim 22 wherein the termination agent is 1-butanethiol, 1-octanethiol, or carbon tetrabromide.

25. A process for the preparation of polymer latex particles consisting essentially of the emulsion polymerization of a mixture of monomer, polar comonomer, water, surfactant, initiator, and a water phase termination agent, and wherein the water phase termination agent is selected from the group consisting of butanethiol, pentanethiol, hexanethiol, heptanethiol, octanethiol, and carbon tetrabromide ($Cbr_4$).

* * * * *